US009675136B2

(12) United States Patent
Hershberger

(10) Patent No.: US 9,675,136 B2
(45) Date of Patent: Jun. 13, 2017

(54) CUSTOMIZABLE FOOTWEAR

(71) Applicant: Amazing Love, LLC, Apple Creek, OH (US)

(72) Inventor: Lisa Hershberger, Apple Creek, OH (US)

(73) Assignee: Amazing Love, LLC, Apple Creek, OH (US)

( * ) Notice: Subject to any disclaimer, the term of this patent is extended or adjusted under 35 U.S.C. 154(b) by 519 days.

(21) Appl. No.: 14/190,565

(22) Filed: Feb. 26, 2014

(65) Prior Publication Data

US 2014/0250724 A1 Sep. 11, 2014

Related U.S. Application Data

(60) Provisional application No. 61/773,418, filed on Mar. 6, 2013.

(51) Int. Cl.
*A43B 23/24* (2006.01)
*A43B 3/24* (2006.01)

(52) U.S. Cl.
CPC ..... *A43B 23/24* (2013.01); *A43B 3/242* (2013.01)

(58) Field of Classification Search
CPC ..... A43B 3/24; A43B 3/0078; A43B 3/242; A43B 3/246; A43B 23/24; A43B 1/0027; A43B 21/42; A43B 1/0081; A43B 13/36; A43B 3/122; A43B 3/126; A43B 3/244; A43B 1/0072; A43B 21/39; A43B 3/103; A43B 3/105; A43B 21/00; A43B 13/14; A43B 13/141; A43B 13/187; A43B 13/223; A43B 1/0054; A43B 13/16; A43B 13/184
USPC ..... 36/100, 112, 101, 102; 245/247
See application file for complete search history.

(56) References Cited

U.S. PATENT DOCUMENTS 1,823,634 A * 9/1931 Wiesner ..... A43B 3/101 36/102
3,023,420 A * 3/1962 Rosabelle ..... A41B 11/001 2/239
3,473,198 A * 10/1969 Meier ..... A43B 3/30 24/712.3
4,697,362 A 10/1987 Wasserman
4,711,043 A * 12/1987 Johnson ..... A43B 23/00 36/139
4,979,924 A * 12/1990 Manger ..... A63H 3/16 428/100
4,985,935 A * 1/1991 Hur ..... A42B 1/004 2/10
5,074,059 A * 12/1991 Melcher ..... A43D 999/00 36/50.5
5,276,985 A * 1/1994 Halloran ..... A42B 1/248 2/209.13
5,673,499 A 10/1997 Attilieni
(Continued)

*Primary Examiner* — Alissa L Hoey
*Assistant Examiner* — Catherine M Ferreira
(74) *Attorney, Agent, or Firm* — Ward Law Office LLC; Jacob M. Ward

(57) ABSTRACT

A customizable footwear system includes customizable footwear and a toy head. The customizable footwear has a main body for placement on a foot of a wearer. The main body has a toe region and a heel region. The toe region has a recess with at least one fastener. The toy head is nested within the recess of the main body and has at least one cooperating fastener removably attached to the at least one fastener of the customizable footwear.

8 Claims, 7 Drawing Sheets

(56) References Cited

U.S. PATENT DOCUMENTS

| | | | | |
|---|---|---|---|---|
| 5,979,085 | A * | 11/1999 | Ross | A43B 3/0078 36/1 |
| 6,006,455 | A | 12/1999 | Miller | |
| 6,412,151 | B1 | 7/2002 | Rowland | |
| 6,412,197 | B1 * | 7/2002 | Krull | A43B 3/0078 24/712.2 |
| 6,475,051 | B1 * | 11/2002 | Griffin | A43B 3/16 36/112 |
| 6,898,873 | B2 * | 5/2005 | Schenone | A43B 3/0078 36/101 |
| 7,237,347 | B2 * | 7/2007 | Tobias | A43B 3/0078 36/112 |
| D554,847 | S | 11/2007 | Schmelzer et al. | |
| 7,698,836 | B2 | 4/2010 | Schmelzer et al. | |
| 7,721,470 | B2 | 5/2010 | Long | |
| 8,104,198 | B2 | 1/2012 | Barras | |
| 2003/0101625 | A1 | 6/2003 | Wu | |
| 2007/0130805 | A1 | 6/2007 | Brady et al. | |
| 2008/0060110 | A1 | 3/2008 | Schmelzer et al. | |
| 2008/0163514 | A1 | 7/2008 | Stassinopoulos | |
| 2009/0300948 | A1 | 12/2009 | Nordstrom-Wehner | |
| 2011/0041363 | A1 | 2/2011 | Stanfield et al. | |

* cited by examiner

CUSTOMIZABLE FOOTWEAR

CROSS-REFERENCE TO RELATED APPLICATIONS

This application claims the benefit of U.S. Provisional Application No. 61/773,418, filed on Mar. 6, 2013. The entire disclosure of the above application is hereby incorporated herein by reference.

FIELD OF THE INVENTION

The present disclosure relates to footwear and, more particularly, to customizable footwear having a variety of accessories.

BACKGROUND OF THE INVENTION

A typical shoe includes two main portions: a sole; and an upper. The entire portion of the shoe that is located below a wearer's foot is generally called the sole. The portion of the shoe that covers an upper portion of the wearer's foot is generally called the upper. The sole may include a variety of components such as an insole for creating a layer of comfort between the sole and the wearer's foot, a midsole for shock absorption, and an outsole formed from a durable material for contacting the ground. Likewise, the upper may include a variety of components, such as a toe cap that covers the front of the wearer's foot, a vamp that covers the mid-front of the wearer's foot, and a quarter that covers the rear and sides of the wearer's foot. The toe cap, vamp, and quarter may be sewn together separately, or provided as one or more integral pieces, and together may be referred to as the "body" of the shoe.

Depending on the shoe design employed, the shoe may also have a fastening portion disposed adjacent an aperture in the shoe where the wearer inserts the wearer's foot. The fastening portion may include fasteners such as laces, zippers, and hook and loop fasteners. A tongue may be provided, generally when the shoe includes a fastening portion with laces, and may run along a top-center of the shoe between the fastener and the wearer's foot. The location of the fastener and the tongue is generally referred to as the instep of the shoe. The typical shoe may also include a variety of other features for affecting the comfort and overall aesthetics of the shoe such as liners, cushions, heels, toe inserts, and design elements for logos and the like.

It is known to provide a shoe that allows the wearer, and a particularly a child wearer, to attach one or more accessories to the shoe and customize the aesthetics thereof. One type of shoe system is described in U.S. Pat. Appl. Pub. No. 2008/0060110 to Schmelzer et al., the entire disclosure of which is hereby incorporated herein by reference. The Schmelzer et al. shoe system attaches a decorative accessory to a molded shoe through an expandable hole formed in the molded shoe. The decorative accessory has a shoulder configured for insertion through the expandable hole. The shoulder is larger than the expandable hole and secures the decorative accessory to the molded shoe when inserted through the expandable hole.

Further nonlimiting examples of known customizable footwear include U.S. Pat. No. 7,721,470 to Long, which discloses a use of magnets in footwear for holding decorative elements. Barras in U.S. Pat. No. 8,104,198 describes the attachment of a stylized bunny head to footwear using rigid strips. In U.S. Pat. No. 5,979,085 to Ross, a decorative shoe is shown having a decorative figurine removably attached to the shoe with hook-and-loop or mechanical fixtures. Stassinopoulous in U.S. Pat. Appl. Pub. No. 20080163514 describes hook-and-loop fasteners for attaching decorative appliqués to shoes. U.S. Pat. No. 7,237,347 to Tobias shows an attachment of a plush toy to a shoe using shoelaces, hooks, and the like. In U.S. Pat. Appl. Pub. No. 20030101625 to Wu, the use of magnets embedded in a shoe for placing a vamp such as letters to an outsole of the shoe is disclosed.

There is a continuing need for footwear that allows a wearer to customize the footwear according to a variety of themes such as animals, movie and cartoon characters, toys, and the like.

SUMMARY OF THE INVENTION

In concordance with the instant disclosure, footwear that allows a wearer to customize the footwear according to a variety of themes such as animals, movie and cartoon characters, and the like, is surprisingly discovered.

In one embodiment, a customizable footwear system includes customizable footwear having a main body for placement on a foot of a wearer. The main body has a toe region and a heel region. The toe region has a recess with at least one fastener. A toy head is nested within the recess of the main body. The toy head has at least one cooperating fastener removably attached to the at least one fastener of the customizable footwear.

The customizable footwear system may also be provided in the form of a kit, having a plurality of interchangeable toy heads for use with the main body of the customizable footwear.

In other embodiments, the customizable footwear has the ability to detach and interchange multiple objects from a main body. Objects may resemble animal heads, arms, legs, and tails. Objects are fastened preferably with hook-and-loop fasteners, but may also be fastened with magnets, snaps, zippers, etc., as nonlimiting examples. This allows a wearer to mix, match, and collect objects to acquire a different look with the same base.

In further embodiments, interchangeable heads will "nest" in the main body in a groove above the toes. Hook-and-loop fasteners on the bottom middle and the back of head may be provided for support and to attach the interchangeable heads to the main body. A tail may also be attached to the heel of the main body with a fastener at a base of the tail.

In additional embodiments, an interchangeable head will attach to the front of the sandal on a strap over the toes, with properly positioned fasteners on the back of the head. Long arms and/or legs attached to the underside/back of the head will extend and wrap once completely around to "hug" the ankle. The long arms and/or legs will connect in the back by the animal's feet with fasteners spaced at intervals, to allow for varying lengths.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Figure 1:
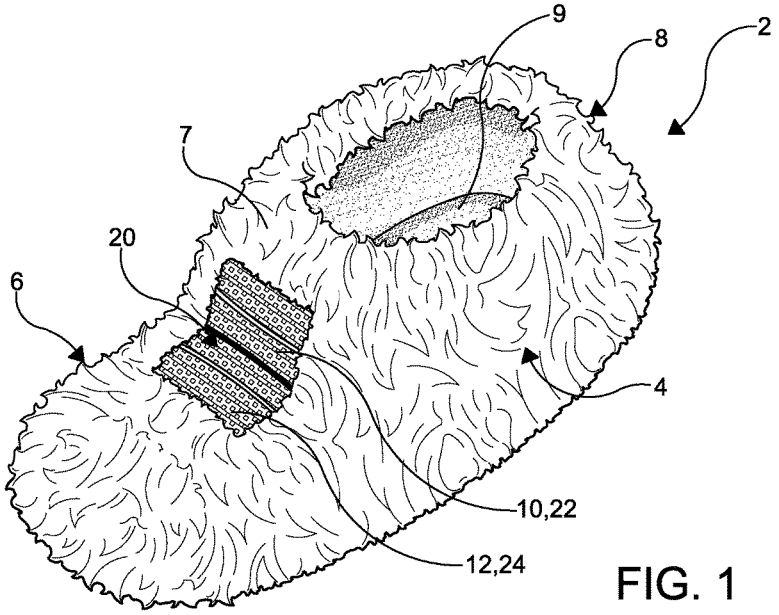
FIG. 1 is a front perspective view of customizable footwear according to one embodiment of the present disclosure.
Figure 2:
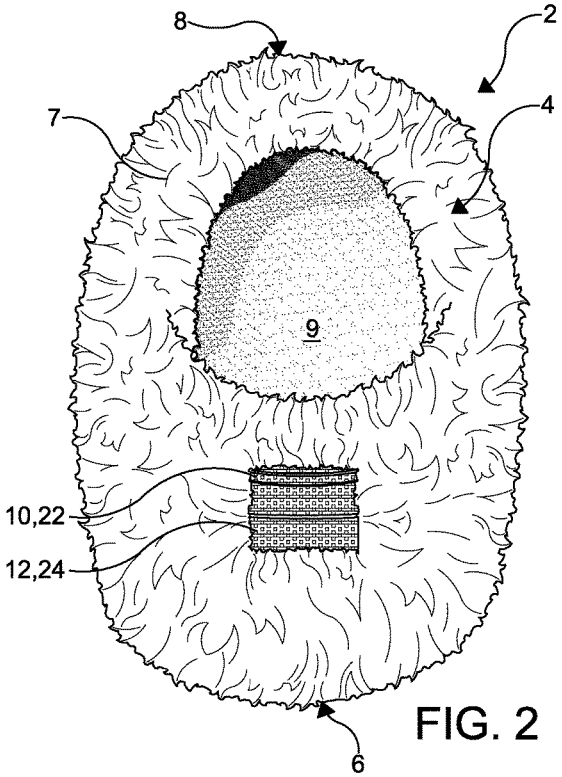
FIG. 2 is a top plan view of the customizable footwear shown in FIG. 1.
Figure 3:
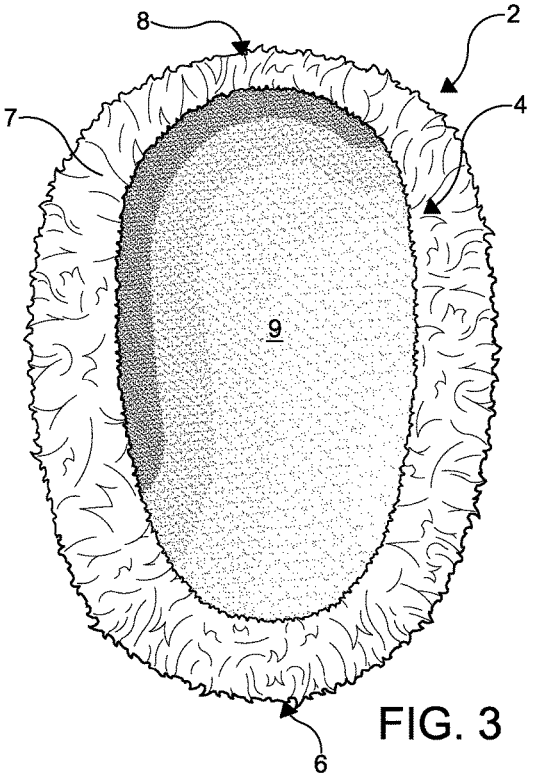
FIG. 3 is a bottom plan view of the customizable footwear shown in FIG. 1.
Figure 5:
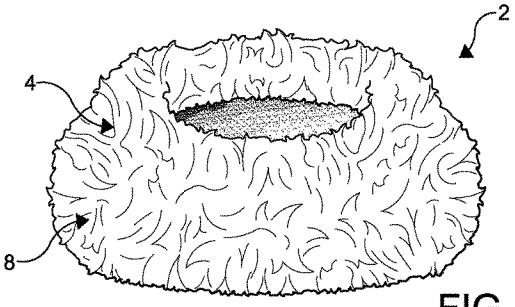
FIG. 5 is a rear elevational view of the customizable footwear shown in FIG. 1.
Figure 4:
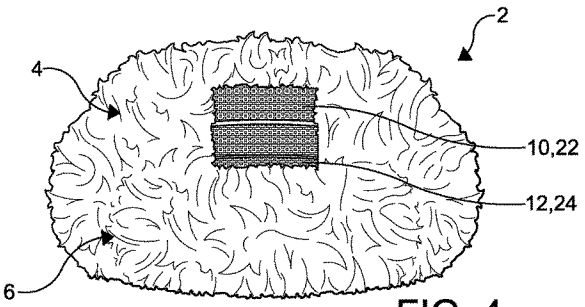
FIG. 4 is a front elevational view of the customizable footwear shown in FIG. 1.
Figure 6:
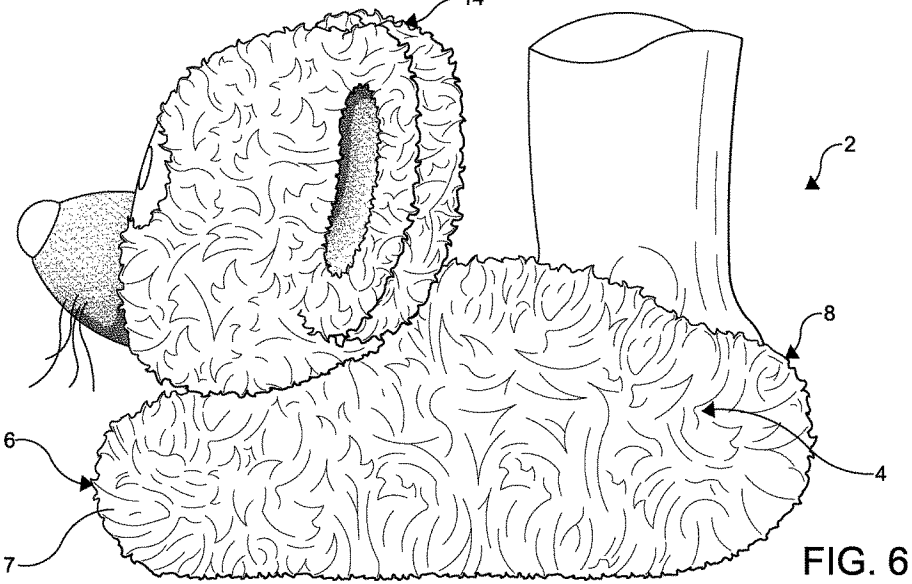
FIG. 6 is a right side elevational view of the customizable footwear shown in FIG. 1, further showing a toy head attached to a main body of the customizable footwear and placed on a foot of a person wearing the customizable footwear.

As shown in FIGS. 1-12, customizable footwear 2 according to the present disclosure includes a main body 4 for placement on a foot of a wearer (shown in FIG. 6). In the embodiment shown, the customizable footwear 2 is a slipper. Although the customizable footwear 2 is largely described and shown in FIGS. 1-12 as the slipper, for purposes of simplicity, one of ordinary skill in the art understands that the customizable footwear may alternatively comprise a shoe, a boot, a sandal (shown in FIGS. 13-15), and other suitable types of footwear designed to be worn by a person, as desired.

The main body 4 of the footwear has a toe region 6 and a heel region 8. In particular, the main body 4 includes an upper 7 for covering a foot of the wearer, and a sole 9 that is disposed between the foot of the wearer and the ground. In particular embodiments, the upper 7 is formed from one of a long pile fabric, a short pile fabric, and a faux fur fabric. A skilled artisan may also select other suitable materials for the upper 7, within the scope of the present disclosure.

The sole 9 may be formed from a material configured to optimize durability and comfort. The sole 9 may comprise a plurality of layers, for example. As particular nonlimiting examples, the sole 9 may be formed from a durable textile, rubber, plastic, or leather. The sole 9 is coupled to the upper 7, for example, by at least one of stitching and adhesive. Other suitable materials for the sole 9 may also be employed, as desired.

Additional structure such as an inner liner and filler configured to provide a plush appearance and texture may also be used. It should be appreciated that suitable materials for these and other structure of the main body 4 of the footwear 2 may also be selected by a skilled artisan within the scope of the present disclosure.

The main body 4 includes at least one fastener 10, 12. The at least one fastener 10, 12 is disposed on the upper 7 of the main body 4 in the toe region 6. The at least one fastener 10, 12 may be affixed to the main body 4 using suitable means such as stitching, adhesives, and the like. The at least one fastener 10, 12 at the toe region 6 is configured for removable attachment of a toy head 14 to the main body 4. The at least one fastener 10, 12 may include at least one of a hook-and-loop fastener, a magnetic fastener, a snap, and a zipper, as nonlimiting examples.

The toy head 14 likewise includes at least one cooperating fastener 16, 18, which cooperates with the at least one fastener 10, 12 to removably attached the toy head 14 to the main body 4.

In a most particular embodiment, the at least one fastener 10, 12 and the at least one cooperating fastener 16, 18 are panels of hook-and-loop fabrics. As one example, suitable hook and loop fabrics are commercially available under the brand name Velcro®, from Velcro Industries B.V. and its affiliates. Other types of hook-and-loop fabrics may also be used, as desired.

In an alternative embodiment, where the at least one fastener 10, 12 and the at least one cooperating fastener 16, 18 are magnetic fasteners, the magnetic fasteners may include a permanent magnet portion and a magnetic coupling portion. The permanent magnet portion may be a rare earth magnet, for example. The magnetic coupling portion is attracted to the permanent magnet portion and may include, as a nonlimiting example, a ferrous material. Other suitable types of permanent magnet portions and magnetic coupling portions may also be used within the scope of the disclosure.

Skilled artisans should also appreciate that, where the at least one fastener 10, 12 and the at least one cooperating fastener 16, 18 are magnetic fasteners, one of the permanent magnet portion and the coupling portion may be disposed within the main body 4. Desirably, the one of the permanent magnet portion and the coupling portion is enclosed within the main body 4 and within the toy head 14, for safety reasons, in order to prevent the magnetic fastener from being easily separated from the main body 4.

Figure 7:
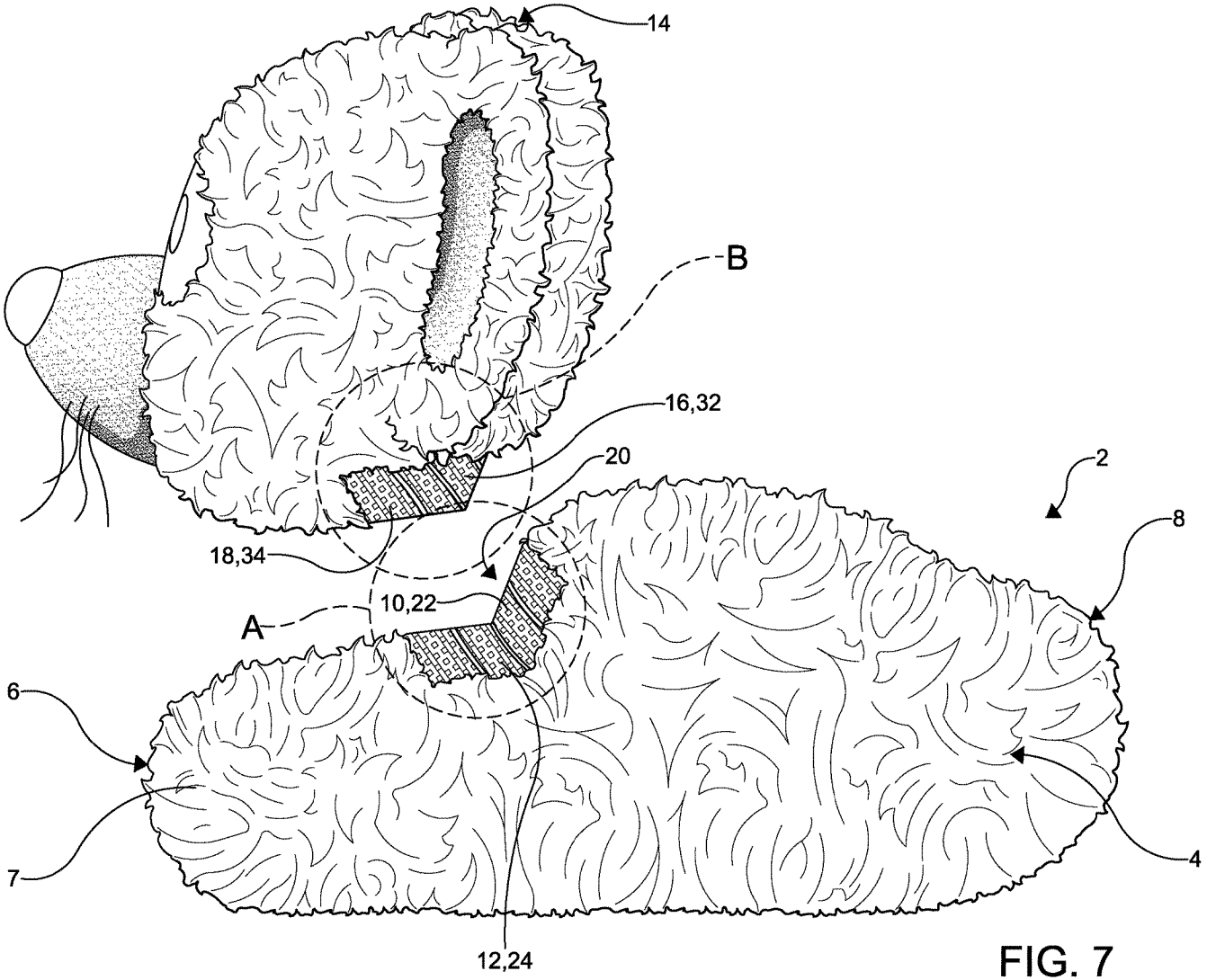
FIG. 7 is an exploded right side elevational view of the customizable footwear shown in FIG. 6, further showing an underside of the toy head with cooperating fasteners for attaching the toy head to fasteners on the main body of the customizable footwear.
Figure 8:
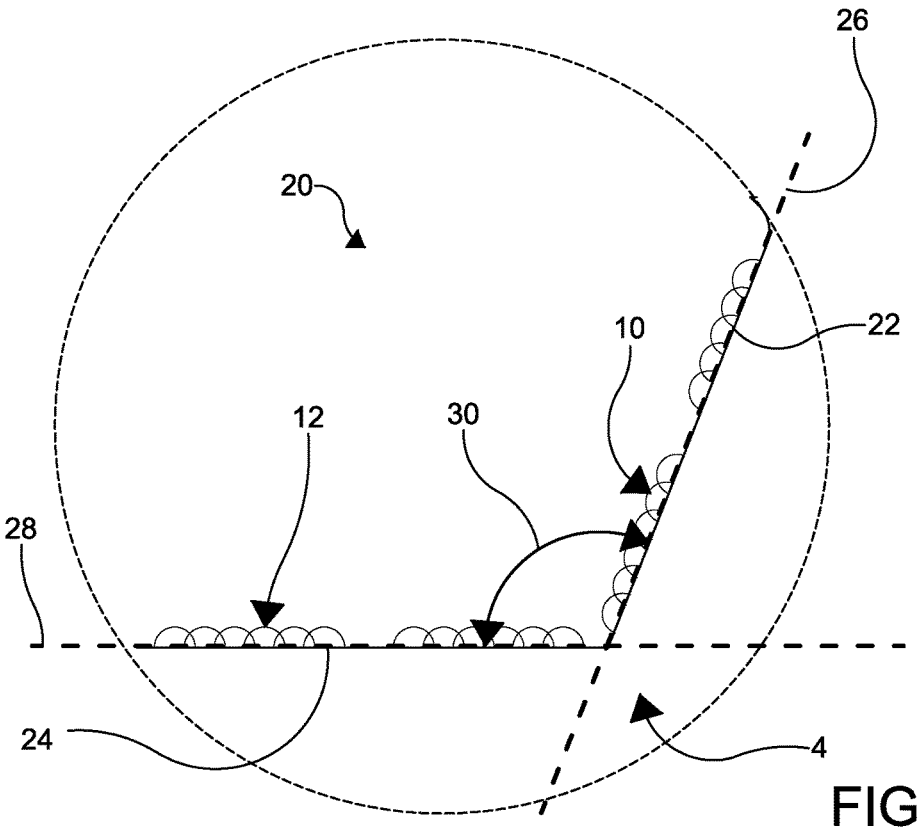
FIG. 8 is an enlarged, fragmentary right side elevational view of the main body of the customizable footwear, taken at callout A in FIG. 7.

As illustrated in FIGS. 7-8, the at least one fastener 10, 12 may be disposed in a recess 20 formed in the upper 7 of the main body 4. The recess 14 may be substantially wedge- or cup-shaped, for example, and have an overall configuration and size appropriate for stabilizing and securely holding the toy head 14 when placed at the toe region 6 of the footwear 2.

In a particular embodiment, the recess 20 is defined by a first surface 22 and a second surface 24. The first surface 22 is disposed along a first plane 26, and the second surface 24 is disposed along a second plane 28. The first plane 26 and the second plane 28 intersect to form a recess angle 30. The recess angle 30 is configured to receive at least two sides of the toy head 14, and to facilitate a nesting of the toy head 14 with the upper 7 of the main body 4. For example, the recess angle 30 may be between about 90° and about 130°, more particularly between about 100° and 120°, and most particularly about 110°. One of ordinary skill in the art may select other suitable recess angles 30 for the recess 20 of the main body 4, as desired.

It should be appreciated that an entirety of the first surface 22 does not need to be disposed on the first plane 26. Similarly, it should be appreciated that an entirety of the second surface 24 does not need to be disposed on the second plane 28. One of ordinary skill in the art understands that a major portion of the first surface 22 and a major portion of the second surface 24 must be generally aligned with their respective planes 26, 28, in order to provide a desired wedge- or pocket-shape for the recess 20 configured to receive the toy head 14.

In an exemplary embodiment, the at least one fastener 10, 12 includes a first fastener 10 and a second fastener 12, and the at least one cooperating fastener 16, 18 includes a first cooperating fastener 16 and a second cooperating fastener 18. The first fastener 10 is disposed on the first surface 22 and the second fastener 12 is disposed on the second surface 24. The first cooperating fastener 16 is disposed on a rear surface 32 of the toy head 14, and the second cooperating fastener 18 is disposed on a bottom surface 34 of the toy head 14.

Figure 9:
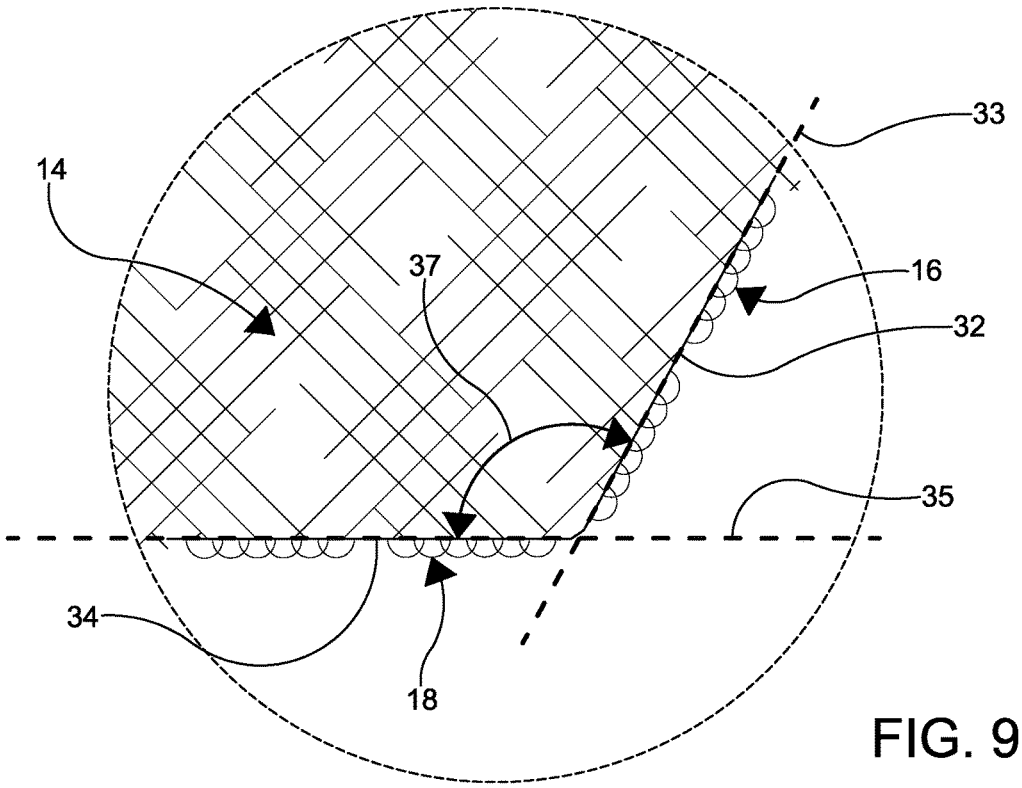
FIG. 9 is an enlarged, fragmentary right side elevational view of the toy head of the customizable footwear, taken at callout B in FIG. 7.
Figure 10:
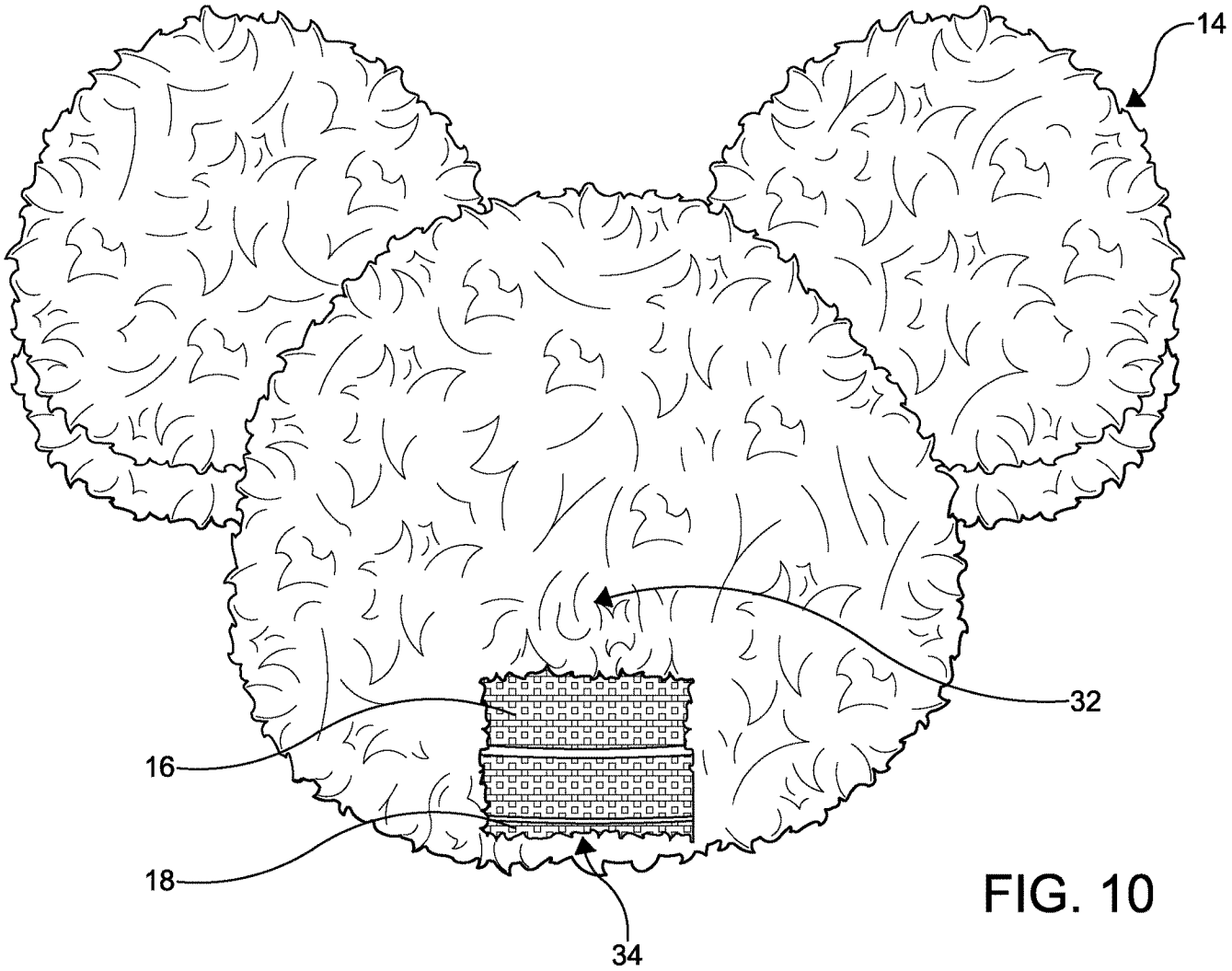
FIG. 10 is a rear elevational view of the toy head shown in FIG. 7.

Like the first surface 22 and the second surface 24 of the recess 20 in the main body 4, the rear surface 32 and the bottom surface 34 of the toy head 14 may be disposed along a third plane 33 and a fourth plane 35, respectively, as illustrated in FIG. 9. The third plane 33 may be oriented substantially parallel with the first plane 26, and the fourth plane 35 may be oriented substantially parallel with the second plane 28, for example. The third plane 33 and the fourth plane 35 also intersect to form a toy head angle 37, which may be substantially the same as the recess angle 30. A skilled artisan understands that the toy head angle 37 being substantially the same as the recess angle 30 facilitates the nesting of the toy head 14 in the recess 20 of the customizable footwear 2.

It should be appreciated that an entirety of the rear surface 32 does not need to be disposed on the third plane 33. Similarly, it should be appreciated that an entirety of the bottom surface 34 does not need to be disposed on the fourth plane 35. One of ordinary skill in the art understands that a major portion of the rear surface 32 and a major portion of the bottom surface 34 must be generally aligned with their respective planes 33, 34 in order to provide a desired shape conforming to the wedge- or cup-shaped recess 20 of the main body 4.

In a most particular example, the first fastener 10, the second fastener 12, the first cooperating fastener 16, and the second cooperating fastener 18 are all separate panels of hook-and-loop fabric that may be stitched to their respective surfaces. In certain embodiments, the first fastener 10 and the second fastener 12 may be separate portions of a single folded panel of hook-and-loop fabric. Likewise, in certain embodiments, the first cooperating fastener 16 and the second cooperating fastener 18 may be separate portions of a singled folded panel of hook-and-loop fabric. It should be appreciated that further fasteners (not shown) may be disposed on other sides of the recess 20 and the toy head 14, to facilitate a securing of the toy head 14 within the recess 20, as desired.

One of ordinary skill in the art should also understand that the main body 4 is configured to receive different types of the toy head 14. As such, the footwear 2 is advantageously customizable to the desired theme of the wearer.

Figure 11:
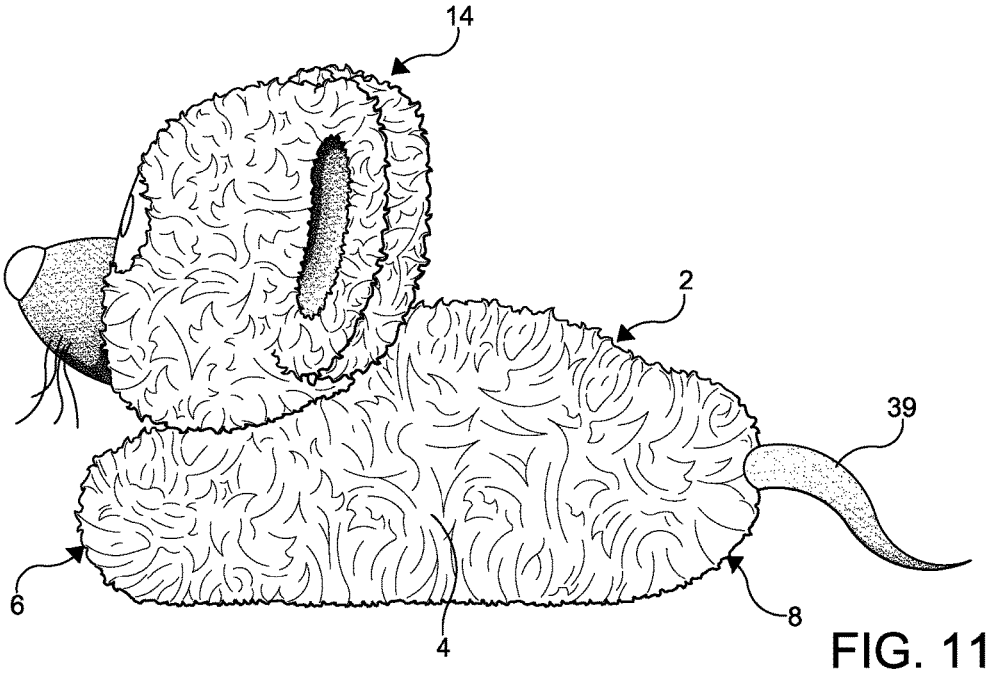
FIG. 11 is a right side elevational view of the customizable footwear depicted in FIG. 1, showing another embodiment of the disclosure with a tail removably attached to the main body of the customizable footwear.
Figure 12:
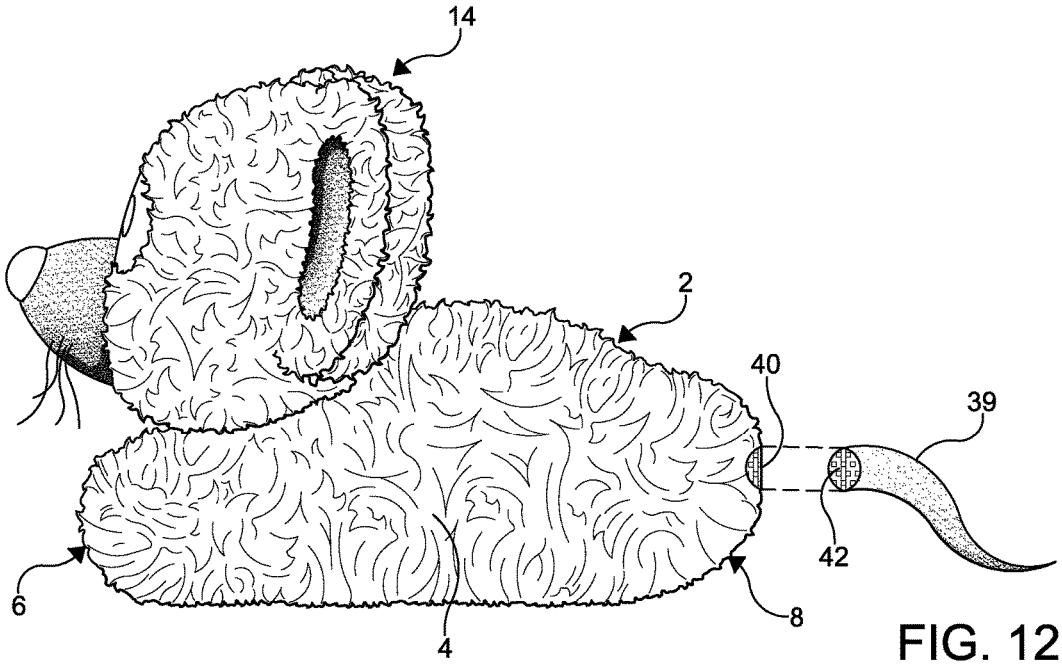
FIG. 12 is an exploded right side elevational view of the customizable footwear shown in FIG. 11.

As shown in FIGS. 11-12, the footwear 2 may further include an additional fastener 40 at the heel region 8 of the main body 4. The additional fastener 40 at the heel region 8 may be configured for removable attachment of a toy tail 39 to the heel region 8. The toy tail 39 has a cooperating additional fastener 42 that may be removably attached to the additional fastener 40, for example.

Where the additional fasteners 40, 42 are magnetic, it should be appreciated that, for safety reasons, the additional fasteners 40, 42 may be enclosed within the main body 4 and a body portion of the toy tail 42, respectively, in order to militate against an easy separation of the additional fasteners 40, 42 from the customizable footwear 2. As with the toy heads 14, different types of the toy tail 39 may be removably affixed to the main body 4, thereby allowing the footwear 2 to be customized to the desired theme of the wearer.

One of ordinary skill in the art should also appreciate that further fasteners (not shown) may be disposed along sides of the main body 4, and also permit the removable placement of appendages such as toy arms (not shown), toy legs (not shown), etc. to the main body 4, as desired. The further customization of the footwear 2 to the desired theme of the wearer is thereby facilitated.

Figure 13:
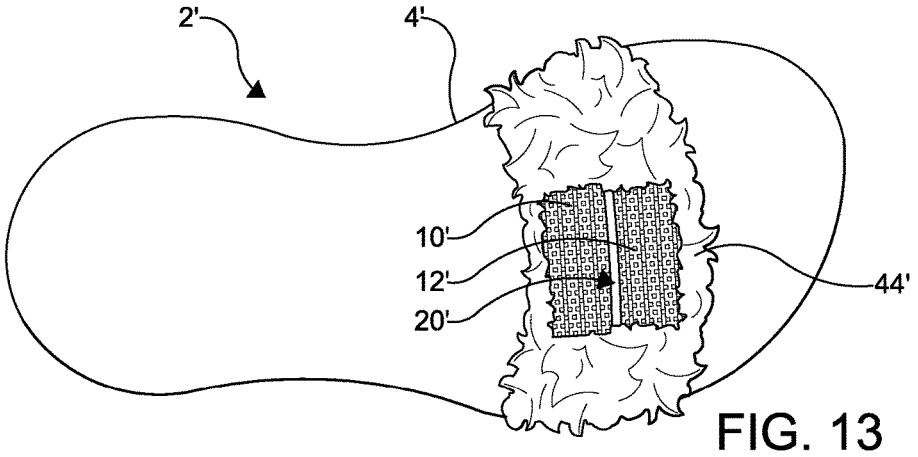
FIG. 13 is a top plan view of customizable footwear according to a further embodiment of the present disclosure, with the main body of the customizable footwear provided in the form of a sandal.
Figure 14:
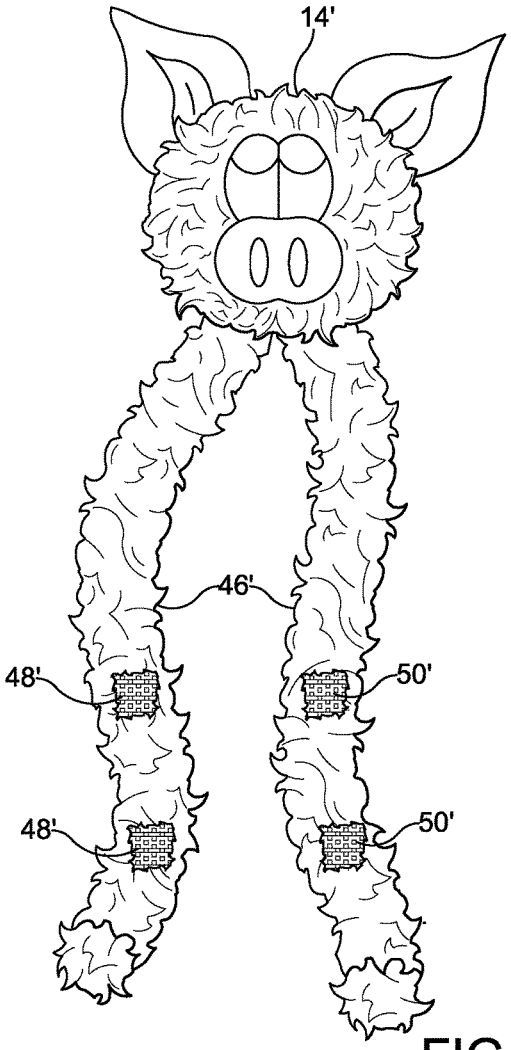
FIG. 14 is a front elevational view of a toy head for the customizable footwear shown in FIG. 13, the toy head further shown with a pair of arms for wrapping around the ankle of a person wearing the customizable footwear.
Figure 15:
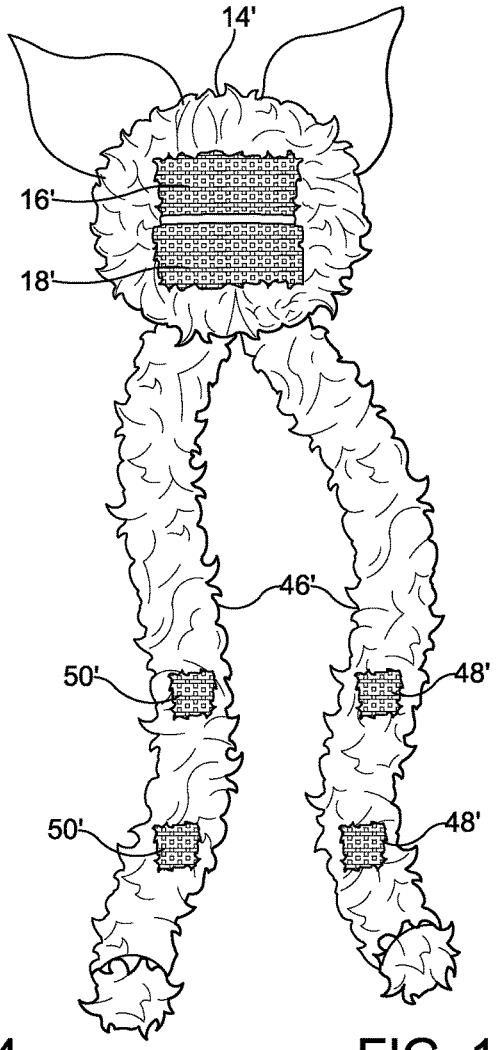
FIG. 15 is a rear elevational view of the toy head depicted in FIG. 14.

The present disclosure includes an embodiment in which the customizable footwear 2' is a sandal, for example, as shown in FIGS. 13-15. Same or like structure to that illustrated in FIGS. 1-12 is identified in FIGS. 13-15 with the same reference number and a prime (') symbol for purpose of clarity.

As shown in FIGS. 13-15, the main body 4' of the footwear 2' may include a strap 44' that holds the footwear 2' on the foot of the wearer. The at least one fastener 10', 12' may be disposed on or within the strap 44', for removably holding the toy head 14 to the main body 4'. The at least one strap 44' may also have the recess 20', as described further hereinabove, for securely holding the toy head 14' in place when used.

Where the toy head 14' is used with the sandal, the toy head 14' may have a pair of flexible arms 46'. The arms 46' are elongate strips of material configured to wrap around an ankle of the wearer when the footwear 2' is being used. The arms 46' may include the at least one arm fastener 48', 50', disposed along a length of each of the arms for purposes of length adjustment. The at least one arm fastener 48', 50' on different ones of the arms 46' cooperate with one another to selectively secure the arms 46' to each other around the ankle of the wearer. The arms 46' permit a further stabilization of the toy head 14' on the footwear 2'.

Advantageously, the footwear 2, 2' of the present disclosure allows the wearer to customize the footwear 2, 2' according to a variety of themes such as animals, movie and cartoon characters, and the like. The accessories used for the customization may be plush toys, for example. However, other types of accessories such as plastic or rubber heads, tails, and appendages may also be employed, as desired.

While certain representative embodiments and details have been shown for purposes of illustrating the invention, it will be apparent to those skilled in the art that various changes may be made without departing from the scope of the disclosure, which is further described in the following appended claims.

What is claimed is:

1. A customizable footwear system, comprising:

customizable footwear including a main body configured to be placed on a foot of a wearer, the main body having a toe region, an ankle region, and a heel region, the ankle region disposed between the toe region and the heel region, wherein an upper surface of the main body at an intersection of the toe region and the ankle region provides a recess with an obtuse angle, and at least one hook-and-loop fastener panel is attached to the upper surface of the main body at the recess, the at least one hook-and-loop fastener panel disposed along a first plane on the toe region, and the at least one hook-and-loop fastener panel disposed along a second plane on the ankle region, the first plane intersecting the second plane to define the obtuse angle; and a toy head removably nested within the recess of the main body, wherein the toy head has at least one hook-and-loop fastener panel attached to a rear surface of the toy head, the at least one hook-and-loop fastener panel of the toy head configured to removably attach to the at least one hook-and-loop fastener panel of the main body and, upon the toy head being attached to the at least one hook-and-loop fastener panel within the recess of the main body, the at least one hook-and-loop fastener panel of the toy head has a toy head angle that conforms to the obtuse angle of the recess of the main body.

2. The customizable footwear system according to claim 1, wherein the main body has one of an upper and a sandal strap, within which the recess is formed.

3. The customizable footwear system according to claim 1, wherein the main body is a slipper and the toy head is a plush head of one of an animal toy, a movie character, and a cartoon character.

4. The customizable footwear system according to claim 1, further comprising a tail removably attached to the heel region of the main body.

5. The customizable footwear system according to claim 4, wherein the heel region has an additional fastener and the tail has a cooperating additional fastener, the additional fastener removably attached to the cooperating additional fastener.

6. The customizable footwear system according to claim 1, wherein the first fastener is removably attached to the first cooperating fastener, and the second fastener is removably attached to the second cooperating fastener.

7. The customizable footwear according to claim 1, wherein the toy head has elongate arms that are attached to one of an underside and a rear side of the toy head, the elongate arms configured to extend and wrap around an ankle of the wearer.

8. A customizable footwear kit, comprising:

customizable footwear including a main body configured to be placed on a foot of a wearer, the main body having a toe region, an ankle region, and a heel region, the ankle region disposed between the toe region and the heel region, wherein an upper surface of the main body at an intersection of the toe region and the ankle region provides a recess with an obtuse angle, and at least one hook-and-loop fastener panel is attached to the upper surface of the main body at the recess, the at least one hook-and-loop fastener panel disposed along a first plane on the toe region, and the at least one hook-and-loop fastener panel disposed along a second plane on the ankle region, the first plane intersecting the second plane to define the obtuse angle; and a plurality of toy heads, each of the toy heads configured to removably nest within the recess of the main body wherein each toy head has at least one hook-and-loop fastener panel attached to a rear surface of the toy head, the at least one hook-and-loop fastener panel of the toy head configured to removably attach to the at least one hook-and-loop fastener panel of the main body and, upon the toy head being attached to the at least one hook-and-loop fastener panel within the recess of the main body, the at least one hook-and-loop fastener panel of the toy head has a toy head angle that conforms to the obtuse angle of the recess of the main body.

* * * * *